United States Patent [19]

D'Luhy

[11] 4,071,142

[45] * Jan. 31, 1978

[54] STUBLESS MULTI-PART ASSEMBLY

[75] Inventor: Emil A. D'Luhy, Youngstown, N.Y.

[73] Assignee: Moore Business Forms, Inc., Niagara Falls, N.Y.

[ * ] Notice: The portion of the term of this patent subsequent to Aug. 2, 1994, has been disclaimed.

[21] Appl. No.: 708,176

[22] Filed: July 23, 1976

Related U.S. Application Data

[63] Continuation-in-part of Ser. No. 623,393, Oct. 17, 1975, Pat. No. 4,039,046.

[51] Int. Cl.[2] ..... B65D 27/34

[52] U.S. Cl. ..... 206/629; 206/632; 282/11.5 R; 282/22 R

[58] Field of Search ..... 282/22 R, 22 A, 23 R, 282/23 A, 24 R, 24 A, 24 B, 24 C, 11.5 R, 11.5 A; 229/68 R, 69, 85; 206/620, 629, 632

[56] References Cited

U.S. PATENT DOCUMENTS

| | | | |
|---|---|---|---|
| 1,949,625 | 3/1934 | Ritzhaupt | 282/22 R |
| 2,105,448 | 1/1938 | Brenn | 282/11.5 R |
| 2,105,449 | 1/1938 | Brenn | 282/11.5 R |
| 2,226,722 | 12/1940 | Jones | 282/22 R |
| 2,330,045 | 9/1943 | Georgiou | 229/85 |
| 3,149,859 | 9/1964 | Otis et al. | 282/11.5 A |
| 3,305,247 | 2/1967 | Fulk | 282/11.5 A |
| 3,325,188 | 6/1967 | Hiersteiner | 229/69 X |

*Primary Examiner*—Stephen P. Garbe

[57] ABSTRACT

A unit set or assembly of several superimposed parts form a mailer without a stub, folded and detachable glue flaps on the top part underlying and being secured to the bottom part. A three-part mailer construction is formed wherein the intermediate part is secured to the bottom part as the adhesive on one of the flaps extends through holes provided in the bottom part. Removal of the top part therefore leaves the intermediate and bottom parts intact, or removal of the intermediate part leaves the top and bottom parts interconnected, or removal of the top and intermediate parts separates each of the parts from one another.

A minimum four-part mailer construction is also provided of superimposed parts with the first part having the folded and detachable glue flaps underlying and secured to the fourth part. The third and fourth parts are provided with axially aligned holes respectively of different sizes, the smaller sized fourth part holes defining masks relative to the larger sized third part holes so that portions of the glue on the one of the flaps extend through such aligned holes. Such glue portions are thereby confined to the smaller sizes of the third part holes so as to be spaced inwardly of the margins of the larger holes. The first part may therefore be removed from the mailer while leaving the remaining parts intact, or separation of the second and fourth parts breaks the glue portions and frees the third part from the mailer while leaving the first and fourth parts interconnected, or removal of the first part together with separation of the second and third parts separates all the parts from one another. The parts of both the three- and four-part constructions may be single plies, or one of the intermediate parts thereof may be a return envelope.

6 Claims, 5 Drawing Figures

STUBLESS MULTI-PART ASSEMBLY

RELATED APPLICATION

This application is a Continuation-In-Part of U.S. application Ser. No. 623,393, filed Oct. 17, 1975 now U.S. Pat. No. 4,039,046.

BACKGROUND OF THE INVENTION

As pointed out in the aforementioned application, superimposed parts of a business form are interconnected into a unitary set typically with the use of a stub portion with the parts detachably connected thereto as by lines of weakening. The stub, however, represents a completely unusable portion of the form since it does not facilitate printing or writing thereon and must be ultimately discarded thereby resulting in not only the need for larger sheets to accept writing or printing, but also creating a wasteful and poorly economical product.

Such a general construction is typical for mailers as well wherein one or more parts are detachably connected to a stub.

As likewise mentioned in the above application, U.S. Pat. No. 1.949,625 to Ritzhaupt discloses a manifolding assembly with all parts thereof connected together by means of adhesive passing through axially aligned holes. Nevertheless, a removable stub is necessary for such construction by reason of the particular arrangement therein disclosed.

SUMMARY OF THE INVENTION

An object of the present invention is to provide a multipart assembly in the form of a mailer which completely avoids the need for a stub thereby improving upon the ease of manufacture, the ease of handling and the economical use of such assembly.

The stubless mailer assembly of the invention has folded glue flaps on the cover ply or first part thereof which underlie the bottom part and are secured thereto for connecting the top and bottom parts together. An intermediate part having holes therein is connected only to the bottom part of a three-part construction as a portion of the glue on one of the flaps extends through such holes for securing the intermediate and the bottom parts together. A wide range of uses is therefore made possible with such construction as, for example: removal of the top part which leaves the intermediate and bottom parts intact, or removal of the intermediate part which leaves the top and bottom parts interconnected, or removal of the top and intermediate parts which facilitates separation of all the parts from one another.

A minimum four-part stubless mailer may also be constructed in accordance with the invention wherein the folded glue flaps of the first part underlie and are secured to the fourth part for connecting these two parts together as well as for connecting parts two, three and four together as portions of the glue on one of the flaps extend through axially aligned openings in parts three and four. The fourth part holes are smaller so that the extending glue portions are masked and are confined to such smaller size so as to lie inwardly of the margin of the larger sized holes of the third part. Hence, removal of the first part leaves the second, third and fourth parts intact, or separation of the second and fourth parts effects a break of the extending adhesive portion and frees the third part from the remaining other parts while leaving the first and fourth parts interconnected, or removal of the first part together with separation of the second and fourth parts separates each of the parts from one another.

Other objects, advantages and novel features of the invention will become more apparent from the detailed description of the invention.

BRIEF DESCRIPTION OF THE INVENTION

DETAILED DESCRIPTION OF THE INVENTION

Figure 1:
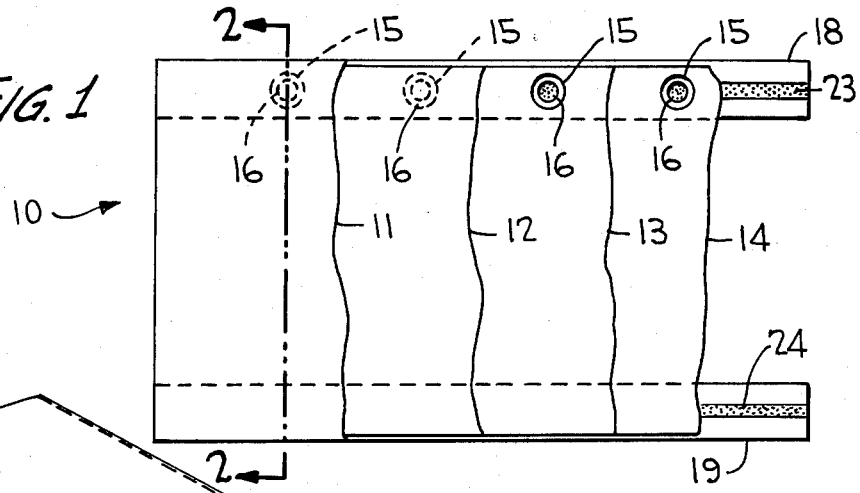
FIG. 1 is a top plan view of a multi-part mailer assembly according to the invention with several of the parts thereof shown broken away for clarity.
Figure 3:
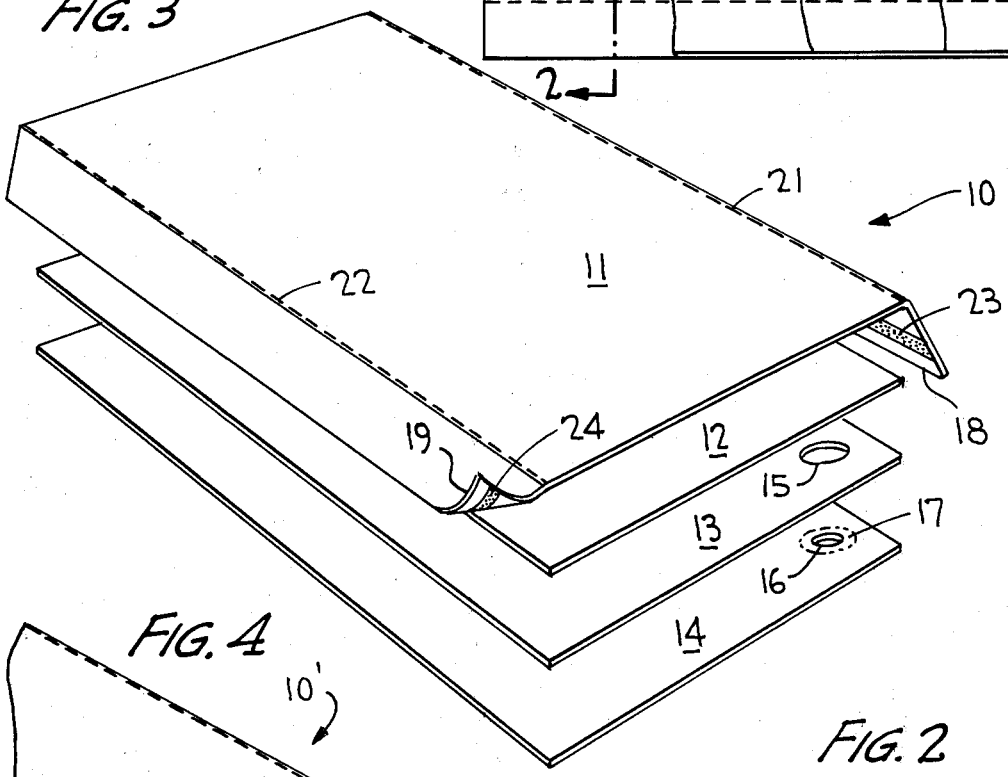
FIG. 3 is an expanded perspective view of the multipart assembly of FIG. 1, slightly enlarged, showing the details of the invention.
Figure 2:
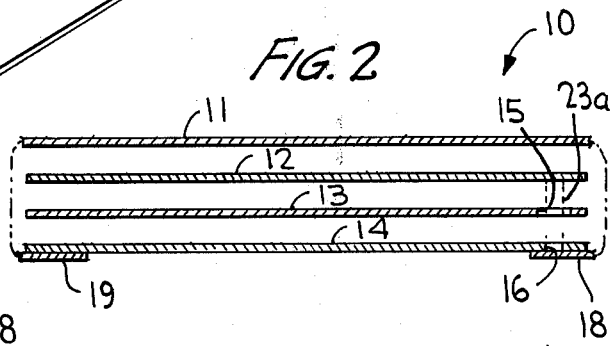
FIG. 2 is a cross-sectional view of the assembly taken substantially along line 2—2 of FIG. 1.

The multiple part assembly constructed as a mailer in accordance with the invention is generally designated 10 in FIGS. 1, 2 and 3 and comprises a minimum of four superimposed parts or plies including a cover part 11, an upper part 12, an intermediate part 13 and a bottom part 14. These parts are elsewhere designated throughout the application as first, second, third and fourth parts 11 to 14 respectively. And, any reasonable number of additional parts 13 may be provided for assembly 10 without departing from the invention.

Holes 15 are provided along a marginal edge of part 13, and holes 16 are provided in part 14 in axial alignment with holes 15. As can be seen in FIGS. 1 to 3, the size of holes 16 are smaller than that of holes 15, the difference in hole sizes defining a mask portion 17 surrounding each hole 16 in part 14. The purpose and operation of each such mask portion will be more clearly brought out hereinafter.

The cover ply or part 11 is provided with a pair of end flaps 18 and 19 detachably secured to the cover along lines 21 and 22 of weakening. Each of these flaps comprise glue flaps having strips 23 and 24 of adhesive thereon for respectively securing these flaps to the underside of bottom part 14 as shown in FIG. 2. Portions **23*a* of the adhesive on flap 18 extend through aligned holes 15 and 16 to thereby adhesively secure part 12 to part 14 and, because of the differently sized holes 15 and 16 thereby defining mask portion 17 as aforedescribed, portions 23*a* of adhesive are confined to the smaller sizes of holes 16. Hence, these portions 23*a* lie inwardly of the margins of larger holes 15 as clearly shown in FIG. 2. Part 13 is therefore immobilized or anchored in place by glue portions 23*a***.

Assembly 10 is therefore constructed as a mailer with opposite side open yet with parts 11 and 14 connected together and with parts 12 and 14 connected together, part 13 being immobilized by glue portions **23*a* spanning parts 12 and 14. Hence, upon receipt of this mailer by the addressee, part 11 may be removed along lines 21 and 22 of weakening whereupon parts 12, 13 and 14 remain intact for some intended use thereof. For example, one or more of the parts 12 to 14 may be duplicate copies of some business transaction to be filled separately or sent individually. The backs of parts 11 to 13 may be partially or completely coated with carbon transfer material and/or with carbonless transfer material of the standard variety for the transfer of images from part 11 onto parts 12 and 13 and therethrough to part 14. Or, part 12 and/or 13** may comprise a return envelope for the reception of one of the remaining parts to be returned to the sender together with a remittance or the like.

If parts 12 to 14 are to remain intact, part 11 is merely removed as in the manner aforedescribed. Otherwise, if it is desired to remove only part 13 from the assembly, part 11 may be partially removed by tearing along line 22 and parts 12 and 14 are separated thereby breaking adhesive portions 23*a* and freeing part 13 while at the same time parts 11 and 14 remain connected together. Otherwise, removal of part 11 together with separation of parts 12 and 14 serves to separate all the parts from one another.

Figure 4:
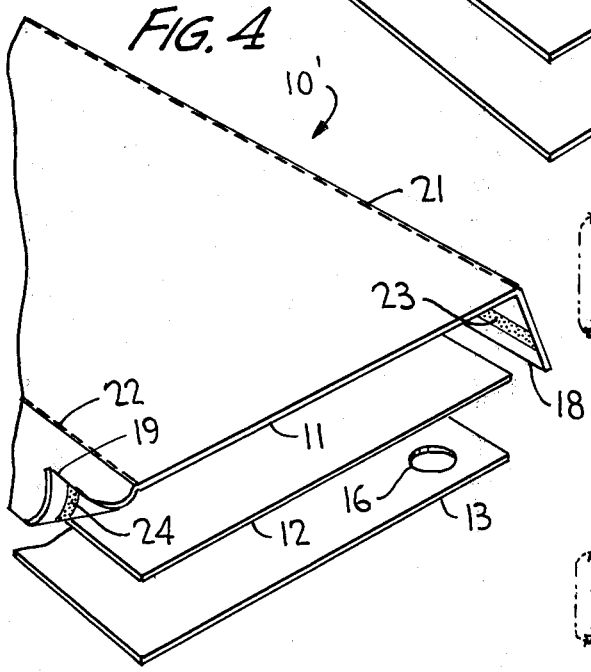
FIG. 4 is a view similar to FIG. 3 of another embodiment according to the invention.
Figure 5:
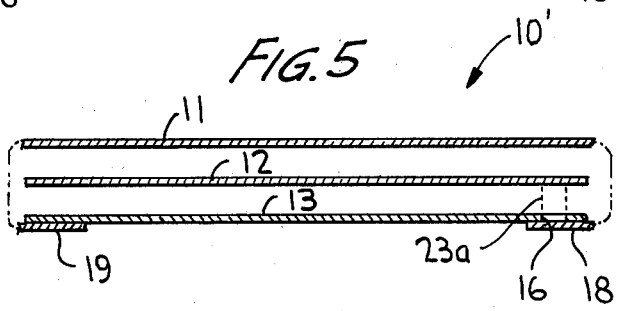
FIG. 5 is a sectional view similar to FIG. 2 of the FIG. 4 assembly.

Another embodiment in accordance with the invention is shown in FIGS. 4 and 5 as assembly 10' which is similar to assembly 10 except that a three-part mailer construction is devised. This assembly 10' comprises parts 11, 12 and 13 which are identical to such parts forming the assembly 10 construction. Glue flaps 18 and 19 underlie part 13 and are secured thereto and, as seen in FIG. 5, portions 23*a* (only one shown) of adhesive 23 extend through openings 16 of part 13 so as to adhesively secure part 12 thereto. Hence, removal of part 11 by separation thereof along lines 21 and 22 of weakening in the assembly 10' embodiment, leaves parts 12 and 13 secured together. Otherwise, removal of part 12 after partially separating part 11 along line 12 of weakening, leaves parts 11 and 13 interconnected. Part 12 is removable from the spots of adhesive defined by holes 16 by simply peeling it apart or snapping, depending on the type of adhesive 23 used. Of course, upon completely removing parts 11 and 12, all the parts become separated.

From the foregoing, it can be seen that a stubless assembly has been devised in which stub waste is avoided which would otherwise be required for similar business form assemblies. Moreover, with use of glue flaps a simple and economical yet highly effective mailer is constructed which may be further converted into a return mailer construction with the provision of a return envelope as one of the parts of the assembly.

Obviously, many modifications and variations of the invention are made possible in the light of the above teachings. It is therefore to be understood that within the scope of the appended claims the invention may be practiced otherwise than as specifically described.

What is claimed is:

1. A multi-part mailer construction, comprising, superimposed first, second, third and fourth parts, said third part having at least one first hole therein of a predetermined first size along one of its margins, a quantity of detachable adhesive extending between said second and fourth parts and through said hole of said third part for securing said second and fourth parts together, said adhesive extending through said first hole having a cross-sectional size which is less than said predetermined size of said first hole so as to be spaced inwardly of the marginal edge of said first hole for retaining said third part in place, said first part having glue flaps on opposing sides thereof underlying said fourth part and being secured thereto whereby said first, second and fourth parts are connected together with said third part being immobilized to form a mailer construction having open sides at other than said opposing sides, one of said flaps having said adhesive thereon, said flaps being removably secured to said first part along opposed lines of weakening, and said parts each being devoid of any tear lines which may form a stub, whereby removal of said first part leaves said second, third and fourth parts intact, or separation of said second and fourth parts effects a break of said adhesive and frees said third part from the remaining of said parts while leaving said first and fourth parts interconnected, or removal of said first part together with separation of said second and fourth parts separates each of said parts from one another.

2. The mailer according to claim 1, wherein at least one second hole of a predetermined second size is provided in said fourth part in axial alignment with said first hole, said cross-sectional size of said adhesive being slightly greater than said second size of said second hole so as to contact the marginal edge thereof, and said second hole serving to mask said first hole for confining said adhesive to said cross-sectional size thereof.

3. The mailer according to claim 2, wherein a plurality of said aligned first and second holes are provided in said third and fourth parts, respectively.

4. A multi-part mailer construction, comprising, superimposed top, intermediate and bottom parts and a cover ply disposed over said top part, glue flaps detachably connected to opposite sides of said cover ply along opposed lines of weakening, said flaps underlying said bottom part and being adhesively secured thereto whereby said ply, said top and bottom parts are connected together with said intermediate part being immobilized to form a mailer construction having open sides at other than said opposite sides, first and second axially aligned holes of different sizes respectively provided in said bottom and intermediate parts, the size of said first hole being less than the size of said second hole, a portion of the glue on one of said flaps being detachable glue and extending through said aligned holes, the size difference between said holes defining a portion of said bottom part which masks said second hole so as to confine the cross-sectional size of said glue portion to the smaller size of said first hole, and said parts each being devoid of any tear line which may form a stub, whereby said cover ply may be removed from the mailer while leaving said parts intact, or separation of said top ply and said bottom part breaks said glue portion and frees said intermediate part from the mailer while leaving said cover ply and bottom part interconnected, or removal of said cover ply together with separation of said top and bottom parts separates said ply and said parts from one another.

5. A multi-part mailer construction, comprising superimposed top, intermediate and bottom parts, said top part having folded glue flaps detachably connected to opposite sides thereof along opposed lines of weakening, said bottom part having at least one hole therein along one of its margins, said flaps underlying said bottom part and being secured thereto whereby all said parts are connected together into a mailer construction having open sides at other than said opposite sides, the glue on one of said flaps being detachable glue and extending through said hole to thereby connect only said intermediate and bottom parts together, and said parts each being devoid of any tear lines which may form a stub, whereby removal of said top part leaves said intermediate and bottom parts intact, or removal of said intermediate part leaves said top and bottom parts interconnected, or removal of said top and intermediate parts separates each of said parts from one another.

6. The mailer according to claim 5, wherein said lines of weakening respectively extend along the folds between said top part and said flaps.

* * * * *